US006664735B2

(12) United States Patent
Kita et al.

(10) Patent No.: US 6,664,735 B2
(45) Date of Patent: Dec. 16, 2003

(54) DIMMER FOR INCANDESENT LAMP

(75) Inventors: Hiroshi Kita, Tokyo (JP); Kenichi Tsuchizaki, Tokyo (JP)

(73) Assignee: Marumo Electric Co., Ltd., Tokyo (JP)

( * ) Notice: Subject to any disclaimer, the term of this patent is extended or adjusted under 35 U.S.C. 154(b) by 22 days.

(21) Appl. No.: 09/928,748

(22) Filed: Aug. 14, 2001

(65) Prior Publication Data

US 2002/0047674 A1 Apr. 25, 2002

(30) Foreign Application Priority Data

Aug. 24, 2000 (JP) ..... 2000-254096
Sep. 13, 2000 (JP) ..... 2000-278331

(51) Int. Cl.[7] ..... G05F 1/00
(52) U.S. Cl. ..... 315/DIG. 4; 315/291; 315/307
(58) Field of Search ..... 315/DIG. 4, 194, 315/199, 291, 294, 307

(56) References Cited

U.S. PATENT DOCUMENTS 4,651,060 A * 3/1987 Clark ..... 315/199
4,728,866 A * 3/1988 Capewell et al. ..... 315/224
5,004,957 A 4/1991 Cunningham ..... 315/199
5,038,081 A * 8/1991 Maiale et al. ..... 315/291
5,066,896 A * 11/1991 Bertenshaw et al. ..... 315/291
5,237,244 A * 8/1993 Bertenshaw et al. ..... 315/291
5,510,679 A * 4/1996 Maiale et al. ..... 315/194
5,539,284 A * 7/1996 Stone ..... 315/360

FOREIGN PATENT DOCUMENTS

WO WO 90/07855 7/1990

* cited by examiner

*Primary Examiner*—Tan Ho
(74) *Attorney, Agent, or Firm*—Dykema Gossett PLLC

(57) ABSTRACT

A dimmer for an incandescent lamp, wherein a phase angle controlling dimmer for performing one time ignition operation every one period of a power supply waveform is used, the ignition angle is varied continuously to perform an optical adjustment operation, each of the electrical powers of positive half cycle and negative half cycle is supplied to individual filaments of a bulb so as to enable an optical adjustment of less variation in color temperature to be attained.

17 Claims, 15 Drawing Sheets

(1) RATED POWER RATIO OF FILAMENT 0.4:0.6

(2) RATED POWER RATIO OF FILAMENT 0.5:0.5

(3) RATED POWER RATIO OF FILAMENT 0.6:0.4

VOLTAGE AT INTER-TERMINALS 14 – 15

(1) FIRING PHASE ANGLE OF POSITIVE HALF-CYCLE (2) FIRING PHASE ANGLE OF NEGATIVE HALF-CYCLE (1) OUTPUT VOLTAGE RATIO OF POSITIVE HALF-CYCLE
(2) OUTPUT VOLTAGE RATIO OF NEGATIVE HALF-CYCLE (1) OUTPUT VOLTAGE RATIO OF POSITIVE HALF-CYCLE
(2) OUTPUT VOLTAGE RATIO OF NEGATIVE HALF-CYCLE

DIMMER FOR INCANDESENT LAMP

BACKGROUND OF THE INVENTION

1. Field of the Invention

This invention relates to a lighting device provided with a lighting instrument with an incandescent lamp which is applied as a light source, and more particularly a dimmer for an incandescent lamp which is suitable for use in stage lighting or TV studio lighting.

2. Description of the Related Art

Although many lighting devices are used in the field of stage lighting or TV studio lighting and the like, a free adjustment of light for a light flux in the lighting equipment is an essential element and a smooth optical adjustment can be carried out, so that also at present, the lighting instrument with an incandescent lamp such as a halogen lamp which is applied as a light source is frequently used.

Optical adjustment of this incandescent lamp lighting device is carried out by controlling a phase angle of an electrical power supplied to the lighting instrument under application of a switching element such as a thyrister and the like.

However, it is well known in the art that when a voltage supplied to the incandescent lamp lighting equipment is controlled to perform an optical adjustment, a color temperature of the light flux generated by the incandescent bulb is substantially varied.

In particular, in the case of TV studio lighting using TV cameras, a variation in color temperature caused by optical adjustment may provide a substantial influence against image quality of TV screen image and this may provide a certain problem so that in order to solve this problem in the prior art, there have been provided some measures that a color filter is used at the lighting equipment to correct a color temperature, or in place of optical adjustment a radiating range angle of the lighting equipment is changed to adjust an illuminance at a lighted surface.

In general, it has been required that a light flux of the halogen lamp is proportional to a multiplication by 3.38 of a supplied voltage and a color temperature is proportional to a multiplication by 0.36 of a supplied voltage in reference to an experiment. Accordingly, a color temperature is proportional to a multiplication by 0.107 of a light flux.

For example, in the case that the halogen lamp with 3,200K at a rated voltage is used, optical adjustment of the light flux is performed to 50%, the color temperature is reduced down to 2,970K. FIG. 1 is a graph showing a specific light flux against a color temperature in the prior art incandescent lighting equipment.

In regard to a less amount of variation in color temperature, although the prior art employed a system in which the reduction in color temperature is avoided by a correction measure with the color filter or adjustment of the lighting equipment as described above, both of them were troublesome measures and they were not necessarily a perfect measures.

In turn, in the gazette of Japanese Patent Publication No. Hei 8-1832 is proposed an optical adjustment method in which when a dimmer circuit is operated in a range of intensity of illumination between 0% and 50% of brightness, only one of a pair of silicon controlling rectifiers is turned on for a predetermined time period and the other silicon controlling rectifier is turned on from a starting point of ½ of an entire cycle to its end, and when the dimmer circuit is operated in a range of intensity of illuminance between 50% and 100% of brightness, the other silicon controlling rectifier circuit is turned on against a predetermined portion of the other half cycle, thereby a predetermined pulse duration period for controlling the intensity of illumination given by the lighting device is controlled, this proposal restricts an acoustic noise produced by the lighting device and the reduction in color temperature is not accommodated.

SUMMARY OF THE INVENTION

The present invention has been invented in reference to such circumstances as found in the prior art, and it is a first object of the present invention to provide a dimmer for an incandescent lamp in which the color temperature is raised fast even if the optical adjustment is carried out and the optical adjustment can be carried out with a less variation in color temperature.

In addition, it is a second object of the present invention to provide a dimmer for an incandescent lamp capable of adjusting light scarcely acknowledging a reduction in color temperature in which when a degree of adjustment of light is increased, the color temperature is maintained after the color temperature reaches the specified value.

In order to accomplish the aforesaid first object, the present invention provides a gist that a dimmer for performing one ignition for every one period of a power supply waveform is used, each of an electrical power of a positive half cycle and an electrical power of a negative half cycle is supplied to each of individual filaments of the bulb, a time of raising of the adjusted light at each of the filaments is displaced and a variation of the color temperature caused by the optical adjustment operation is reduced.

That is, a first aspect of the present invention consists in a dimmer for an incandescent lamp capable of adjusting light with a less variation in color temperature in which a phase angle controlling optical adjuster for performing one ignition operation every one period of the electrical power waveform is used and its ignition angle is changed continuously to perform an optical adjustment operation, each of the electrical power of positive half cycle and the electrical power of negative half cycle is supplied to each of the individual filaments.

In accordance with such means as described above, the electrical power of positive half cycle and the electrical power of negative half cycle are controlled continuously for optical adjustment, each of the electrical powers is supplied to individual filaments to cause one filament to be raised fast and the other filament to be raised in delay, resulting in that a variation in color temperature can be reduced remarkably when the optical adjustment is performed.

As an embodiment of the individual filaments in the aforesaid first aspect, it is possible to provide an embodiment in which the bulb having two filaments enclosed with an intermediate terminal installed in the same bulb is used.

In addition, a rated electrical power ratio of the two filaments enclosed in the aforesaid same bulb is changed to enable the characteristic in variation of color temperature to be optionally set.

As an embodiment of the individual filaments in the aforesaid first aspect, a plurality of bulbs are installed within the same lighting equipment, one bulb lit in optical adjustment in a positive half cycle and the other bulb lit in optical adjustment in a negative half cycle are discriminated to enable a similar effect to be attained. A plurality of bulbs defined in this case are two bulbs or more and they include both an even number and an odd number.

It is preferable that a rated electrical power ratio of a plurality of bulbs installed in the aforesaid same lighting equipment is changed.

As an embodiment of means for continuously changing an ignition angle of the phase angle controlling optical adjuster related to the aforesaid first aspect, it can be accomplished by arranging the optical adjustment controlling function signal generator forming the waveform synchronized with the power supply waveform and corresponded to one period of the power supply, a comparator and a switching element.

In order to accomplish the aforesaid second object, the present invention has a gist in which a dimmer capable of individually controlling the electrical power of positive half cycle and the electrical power of negative half cycle is used, each of the electrical power of positive half cycle and the electrical power of negative half cycle is supplied to each of the individual filaments of the bulbs, supplying of the electrical power in the second filament is started when the first filament while increasing the specific light flux reaches a specified color temperature (for example, 97% of the rated color temperature), at this time a reduction in color temperature caused by lighting up of the second filament is accommodated by further increasing a supplying of the electrical power at the first filament, thereby a reduction in the color temperature caused by starting the lighting up the second filament is prevented.

That is, the second aspect of the present invention is characterized in that there is provided a dimmer capable of individually controlling a positive half cycle and a negative half cycle of an AC power supply voltage, the electrical power of the positive half cycle and the electrical power of negative half cycle are discriminated by the dimmer and each of the electrical powers is supplied to another filament of the bulb, and at the same time, when the first filament reaches the specified color temperature, supplying of the electrical power to the second filament is started, supplying of the electrical power to the first filament is further increased to accommodate for a reduction in the color temperature.

In accordance with the second aspect of the present invention, it is possible to eliminate the improvement left by the aforesaid first aspect and to prevent a reduction in color temperature during the adjustment of light.

More particularly, in the aforesaid first aspect, the second filament starts to light up after the first filament in the bulb reaches the rated electrical power (100% of a rated color temperature) when the specific light flux rises continuously as shown in FIG. 2, so that it is acknowledged that a slight reduction in color temperature occurs during a time in which the second filament reaches the rated electrical power. The second aspect of the present invention improves this feature, resulting in that an optical adjustment with a quite less variation of color temperature in the incandescent lamp lighting equipment can be carried out.

As an embodiment of another filament in the bulb in the aforesaid second aspect, similar effect may also be attained by applying a bulb enclosed with two filaments having an intermediate terminal in the same bulb, and by separately supplying an electrical power of the positive half cycle and an electrical power of the negative half cycle to each of the filaments in the bulb.

In addition, a characteristic in variation of color temperature can be optionally set by relatively changing the rated electrical power ratio of the two filaments enclosed in the aforesaid same bulb.

As an embodiment of another filament in the bulb in the aforesaid second aspect, a plurality of bulbs can be installed in the same lighting equipment and the bulbs optically adjusted to be lit can be discriminated with the electrical power of positive half cycle and the electrical power of negative half cycle. In this case, a plurality of bulbs are defined as two or more bulbs and any of the even number of or odd number of bulbs can be included.

Further, the rated electrical power ratio of a plurality of bulbs to be installed in the aforesaid same lighting equipment are relatively changed, resulting in that a characteristic of the variation in the color temperature can be optionally set.

As an embodiment of the dimmer relating to the aforesaid second aspect, it can be accomplished by using a dimmer comprised of an optical adjustment control function signal generator synchronizing with an electrical power waveform and formed with a waveform corresponding to one period of the electrical power, a comparator, and a switching element for controlling respectively each of the electrical power of the positive half cycle and the electrical power of the negative half cycle, wherein it is formed such that a function waveform of the aforesaid function signal generator and an output of an operating unit for performing an optical adjusting operation are compared by the comparator, an output can be attained at the comparator for a period in which an output of the operating unit exceeds a voltage of the function waveform, the switching element is ignited with the output of the comparator, an ignition angle of the phase angle controlling dimmer is changed continuously, each of the electrical power of positive half cycle and the electrical power of negative half cycle is supplied to a separate filament and at the same time when the first filament reaches a specified color temperature, supplying of the electrical power to the second filament is started and supplying of the electrical power to the first filament is further controlled to be increased.

As the aforesaid optical adjustment control function signal generator, it can be applied whatever devices of the analogue device and the digital device may be applied.

DESCRIPTION OF THE PREFERRED EMBODIMENTS

Figure 1:
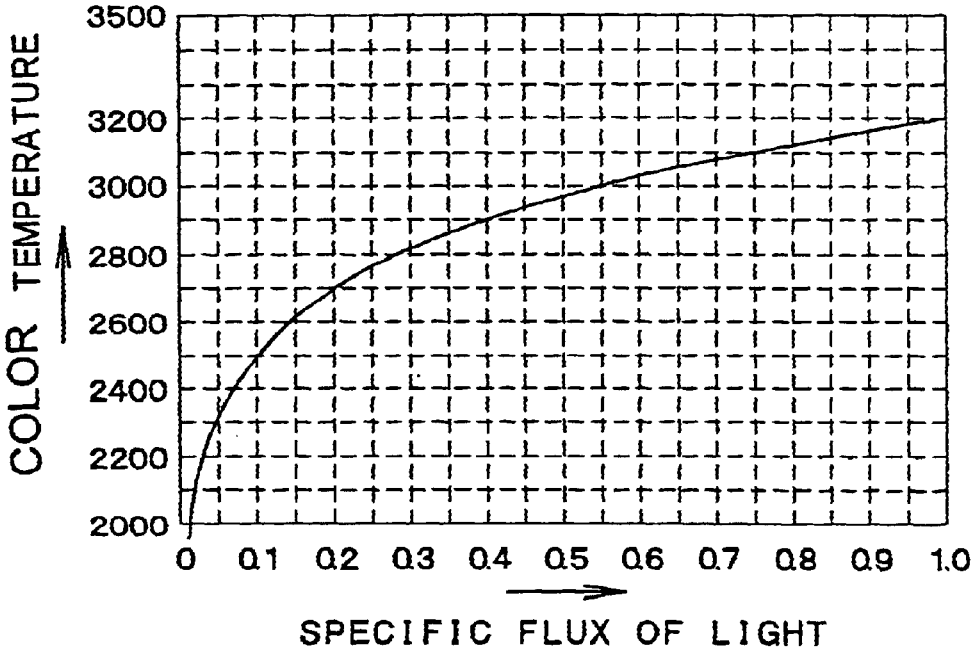
FIG. 1 is a graph for indicating a specific light flux v.s a characteristic of color temperature in the prior art lighting device.

Referring now to the drawings, the preferred embodiments of the present invention will be described as follows.

First Aspect

At first, an example of a dimmer for an incandescent lamp in the first aspect of the present invention will be described.

Figure 3:
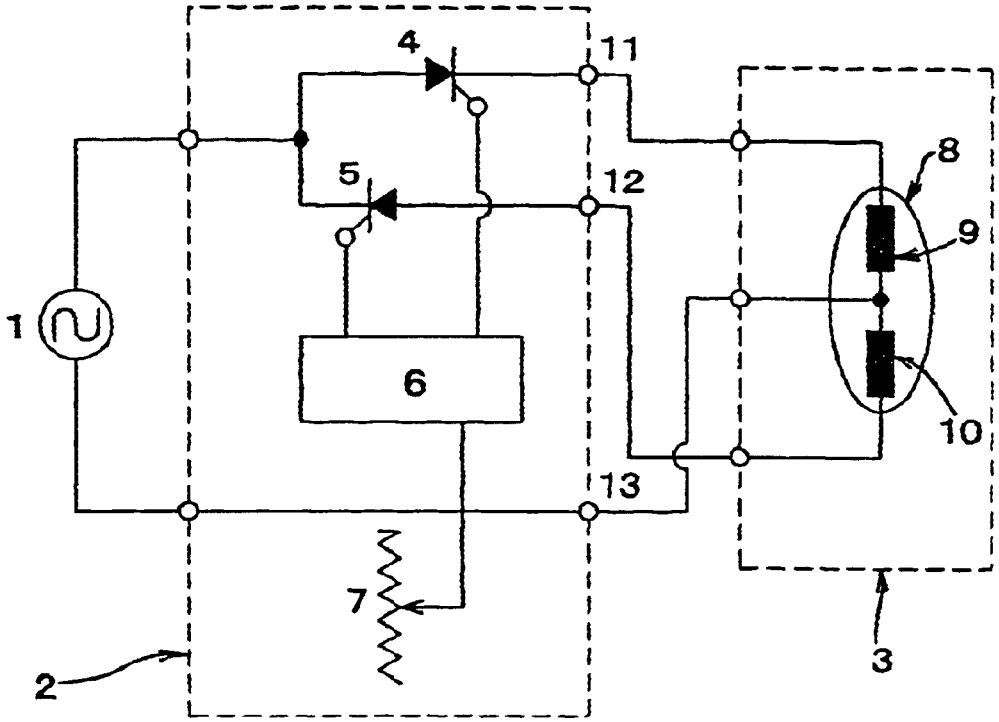
FIG. 3 is a circuit configuration view showing one example of the preferred embodiment of the present invention.

In the first example shown in FIG. 3, reference numeral 1 in the figure denotes an AC power supply, reference numeral 2 denotes a thyristor dimmer including an operating unit, and reference numeral 3 denotes a lighting equipment having an incandescent lamp 8.

The dimmer 2 is comprised of thyristor elements 4, 5 connected in an inverse direction from each other, an ignition circuit 6 and an operating unit 7 for performing an optical adjustment.

Figure 4:
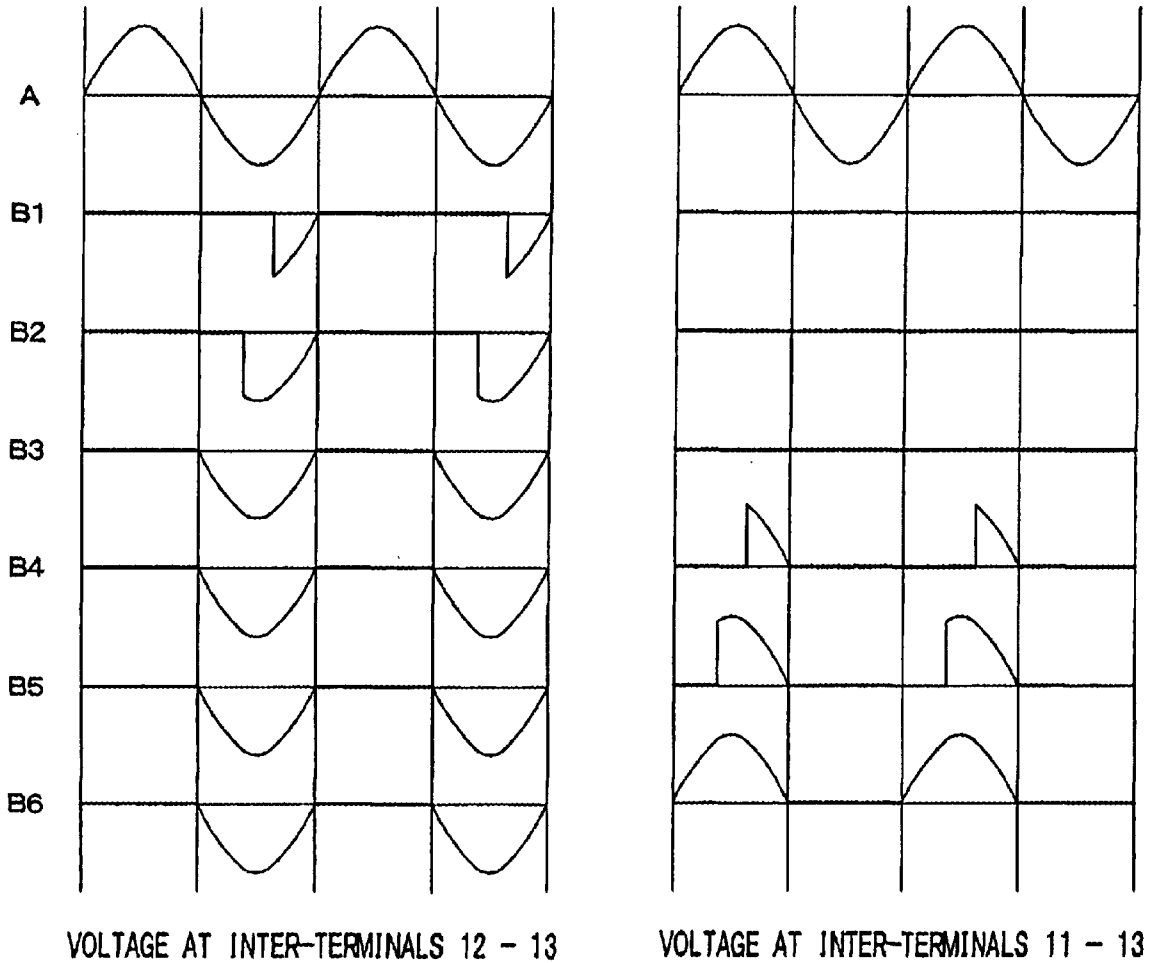
FIG. 4 is an output voltage waveform diagram in the example of the first aspect.

Operation of this dimmer 2 is different from that of the prior art thyristor dimmer, wherein its phase angle is controlled to perform an ignition over an entire one period of the power supply waveform and its output voltage waveform is shown in FIG. 4. In FIG. 4, output voltage waveforms between output terminals 12–13 and 11–13 of the dimmer 2 are shown.

Reference symbol A denotes a power supply voltage waveform.

As a value at the dimmer operating unit 7 is increased from its minimum state, the output voltage of the dimmer 2 is changed as indicated at B1–B2–B3–B4–B5–B6. At first, when the operating unit 7 is slightly increased in its value, a state B1 appears and an output appears between terminals 12–13, although a voltage between terminals 11–13 keeps its 0 state.

As the value at the operating unit 7 is increased, a voltage between the terminals 11–13 is increased up to a state shown at B3 and subsequently it keeps a state of half-wave conductive state.

In turn, a voltage between the terminals 11–13 keeps 0 up to B3 and its output voltage is increased between B4–B6.

When these output voltages are applied to the incandescent lamp 8 having an intermediate terminal of the lighting equipment 3, a filament 10 in the incandescent lamp 8 is lit in optical adjusting manner between B1–B3 and another filament 9 is lit in optical adjusting manner between B4–B6. It is of course apparent that the filament 10 lights in 100% between B4–B6.

In the case that the power supply voltage is 100V, a maximum voltage between the terminals 12–13 and the terminals 11–13 is 71V and accordingly, a rated voltage of each of two filaments 9, 10 of the incandescent lamp 8 is 71V, respectively.

Now, it is assumed that the rated values such as an electrical power and an efficiency of both filaments 9, 10 are the same value to each other and each of the specific light flux and color temperature of the filament 10 is defined as LUX1, COL1, respectively, and each of the specific light flux and color temperature of the filament 9 is defined as LUX2, COL2, respectively, resulting in that a specific light flux of an entire incandescent lamp 8 during its optical adjustment operation is (LUX1+LUX2)/2 and a color temperature of the bulb light flux is (LUX1×COL1+LUX2×COL2)/(LUX1+LUX2), respectively.

Figure 5:
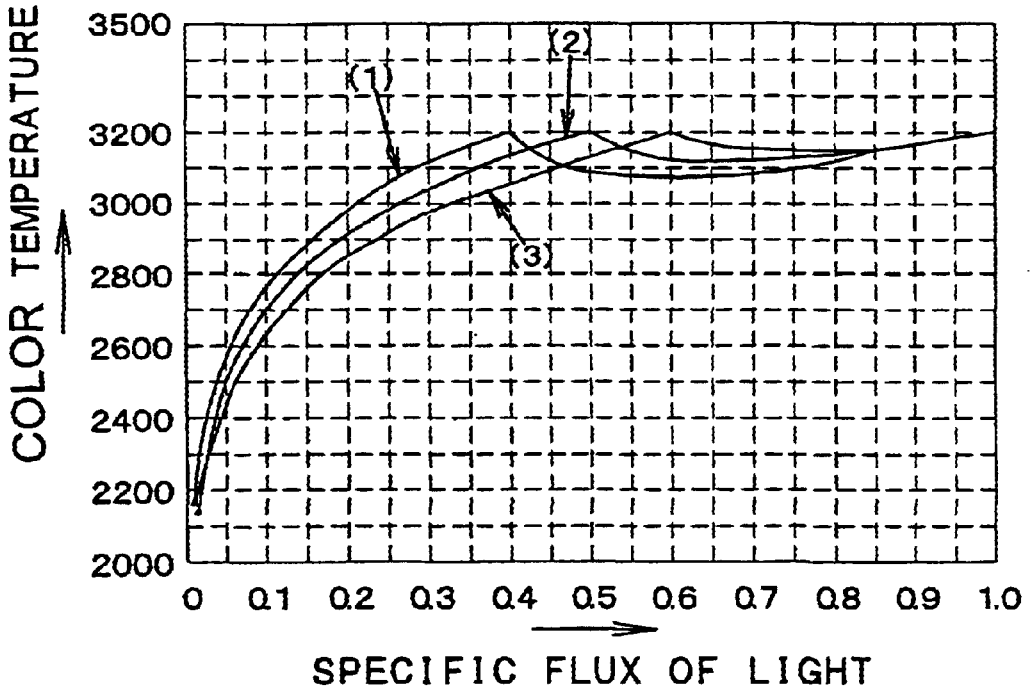
FIG. 5 is a graph of a specific light flux v.s a color temperature in the example of the first aspect.

At (2) in the graph of FIG. 5 is indicated a characteristic of specific light flux v.s a color temperature in the case that a rated color temperature of the incandescent bulb 8 is 3,200K and a bulb having two filaments of same rated value is applied. In FIG. 5(2), the filament 10 rapidly lights up in a specific light flux from 0% to 50%, and the color temperature reaches 3,200K at 50%. At a range of 50% to 100% of the specific light flux, the filament 9 is lit, the color temperature of the entire incandescent lamp 8 is slightly decreased, although its variation is kept within 100K. In regard to the entire range of optical adjustment, comparing the prior art variation in color temperature (FIG. 1) with the variation in color temperature of the present invention (FIG. 5(2)) also shows that an improvement of color temperature more than 200K is found in a range of specific light flux of 10% to 50%.

In FIG. 5(2), although the rated values of the two filaments 9, 10 in the incandescent bulb 8 are the same to each other, setting of the rated electrical powers of the two filaments 9, 10 to different values enables a stage in the variation in color temperature to be changed.

For example, if a specific rated electrical power of the filament 10 is 0.4 and a specific rated electrical power of the filament 9 is 0.6, as shown at (1) in the graph of FIG. 5, the color temperature at the entire light flux of 0.4 becomes 3,200K, the color temperature of 3,090K can be assured at 27% or more of a specific light flux and a reduction in color temperature in a range of low illuminance can be further improved.

In addition, if a specific rated electrical power of the filament 10 is 0.6 and a specific rated electrical power of the filament 9 is 0.4, as shown at (3) in the graph of FIG. 5, the color temperature becomes 3,200K at the entire light flux of 0.6, the color temperature of 3,000K can be assured at 32% or more of the specific light flux and a variation in the color temperature can be reduced.

As described above, either the rated electrical power or the rated color temperature of both filaments is optionally selected, thereby an optional color temperature process curve can be set.

Figure 6:
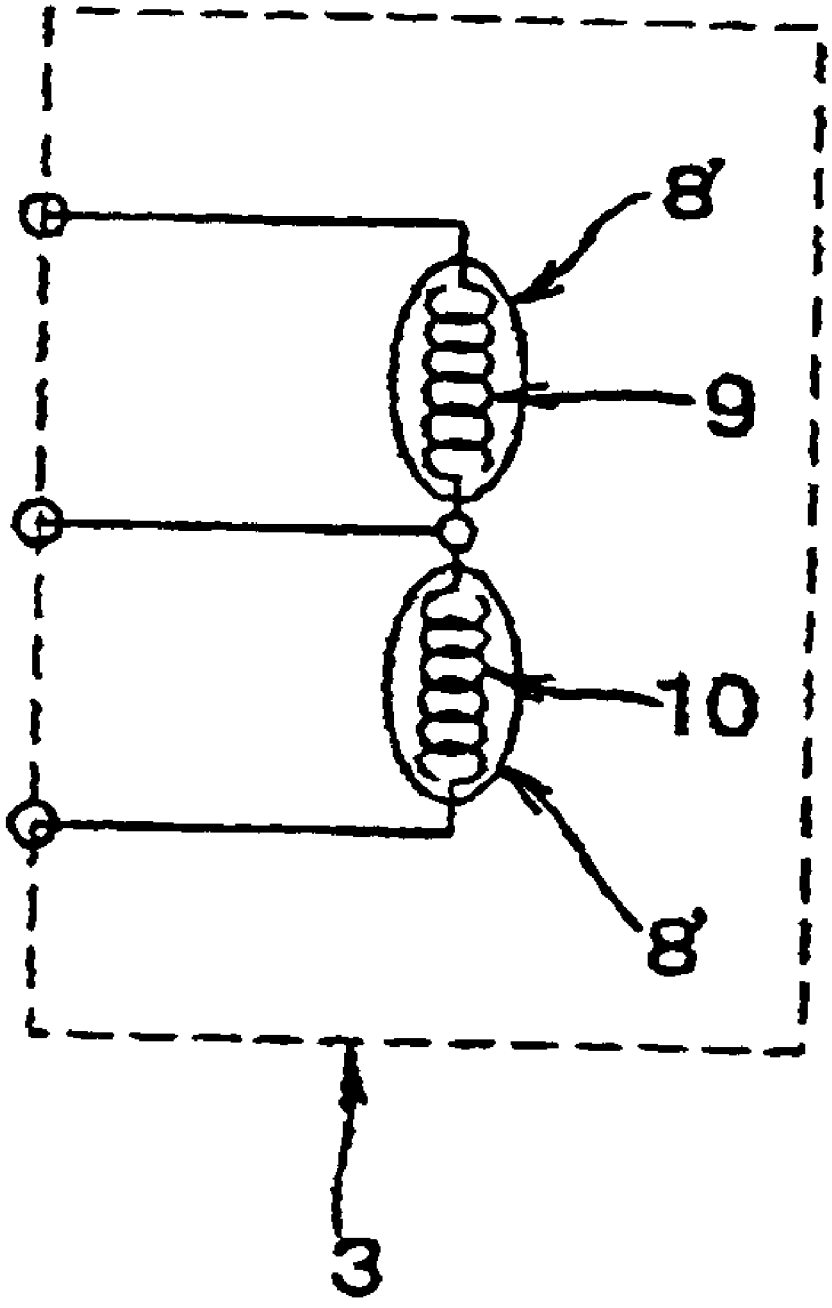
FIG. 6 is a circuit configuration showing an example using two bulbs in the lighting equipment of FIG. 3 with a part being eliminated.

In addition, as the incandescent lamp, there has been described about a bulb in the aforesaid example having an intermediate terminal, although as shown in FIG. 6, application of the dimmer 2 operated as shown in FIG. 4 enables the lighting equipment 3 using a plurality of unit filament bulbs 8', 8 within the same lighting equipment to attain a similar effect.

Figure 7:
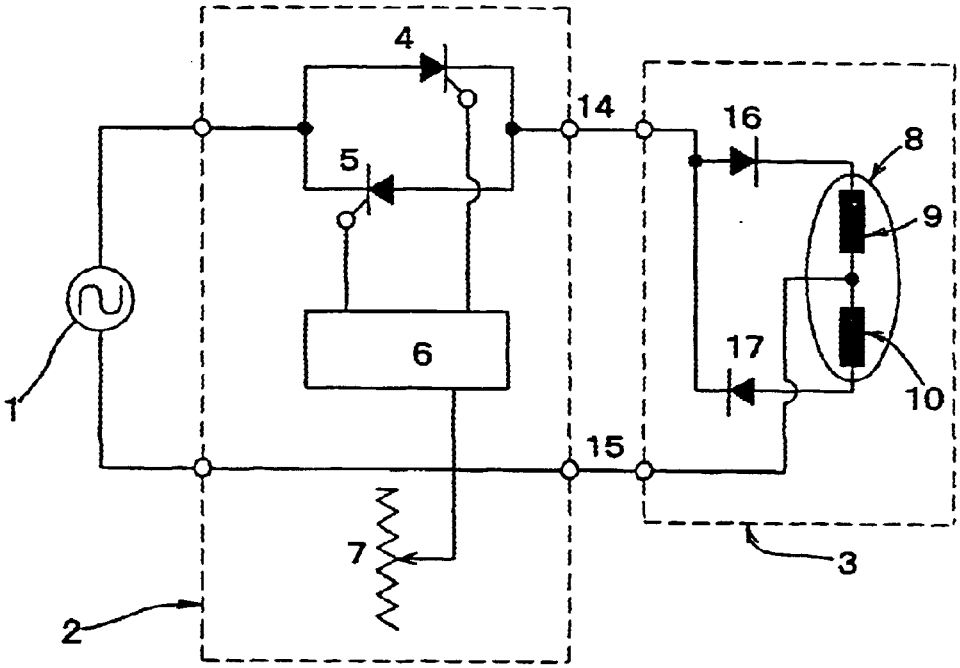
FIG. 7 is a circuit configuration view showing another example of the preferred embodiment of the present invention.

In FIG. 7 is illustrated a second example.

In the case of example shown in FIGS. 3 and 6, it requires some problems that three electrical power supplying lines from the dimmer 2 to the lighting equipment 3 are needed and the outlet of normal 2P or plug can not be used.

In the example shown in FIG. 7, it is possible to provide the lighting device showing less variation in color temperature only with two electrical power lines. In FIG. 7, the elements having the same reference numerals as those shown in FIG. 3 are the elements showing the same operation and having the same action and effect, wherein the thyristor elements 4 and 5 are connected in reverse parallel to each other.

Figure 8:
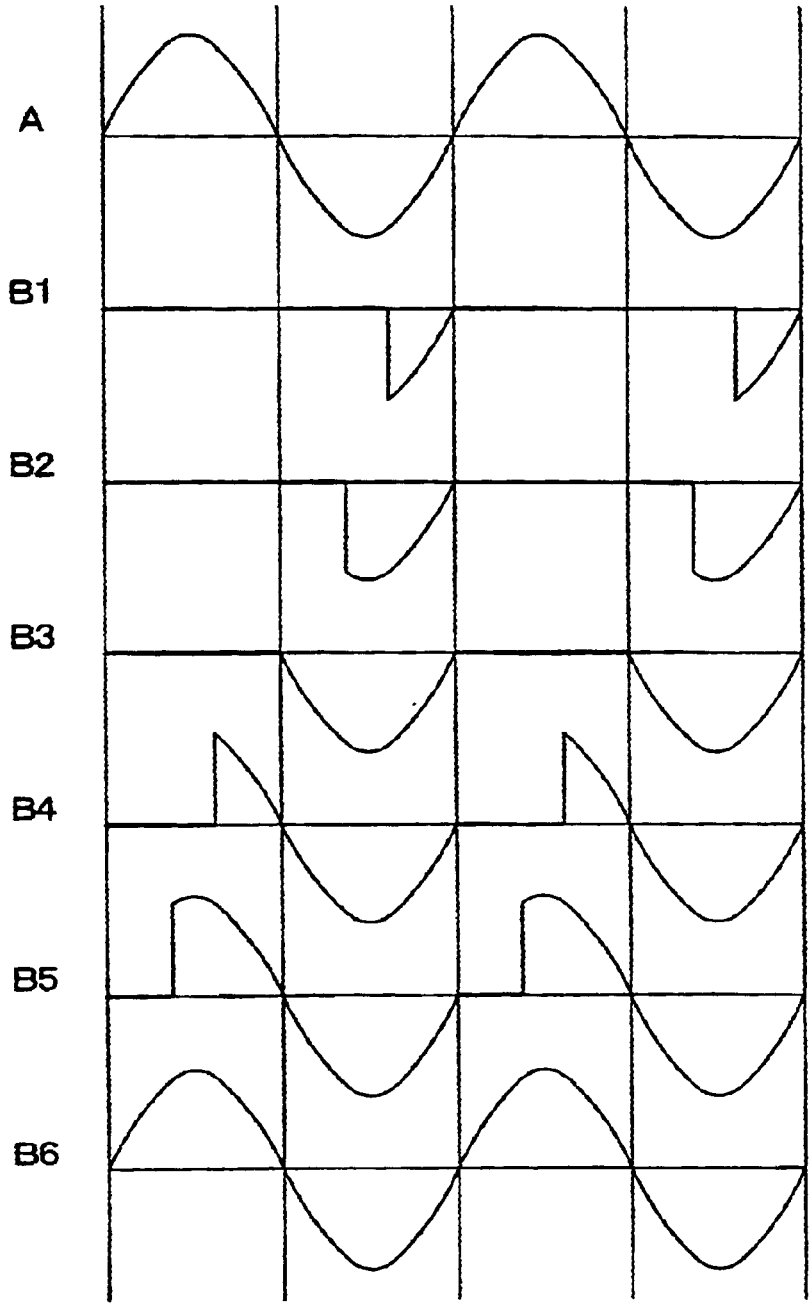
FIG. 8 is an output voltage waveform view in the example of the first aspect.

In FIG. 8 is shown a voltage waveform between the output terminals 14–15 in the case that the operating unit 7 is operated in the second example. In FIG. 8, reference symbol A denotes a waveform of the power supply voltage and as an output of the operating unit 7 is increased, the output voltage waveform between the terminals 14–15 is changed like B1–B2–B3–B4–B5–B6.

Supplying of an electrical power having such a voltage waveform to the lighting equipment 3 causes an electrical power to be supplied to the filament 9 at the positive half cycle in the lighting equipment 3 and further causes an electrical power to be supplied to the filament 10 at the negative half cycle through rectifiers 16, 17, respectively, so that the filament 10 between B1–B3 is optically adjusted and lit, the filament 10 between B4–B6 is in 100% and the filament 9 is optically adjusted and lit, resulting in that the same effect as that of the aforesaid first example can be attained.

The rectifiers 16, 17 in FIG. 7 can be optionally connected to the connectors or terminals of the lighting equipment 3.

In the case that either the rectifier 16 or 17 is eliminated and short circuited, both filaments 9, 10 are optically adjusted and lit in the initial half cycle and the filament 9 reaches a lit state of 100% in a subsequent half cycle, so that an effect of improving color temperature shown in FIG. 5 can not be expected, although it is further improved than a variation in color temperature in the prior art shown in FIG. 1.

Figure 9:
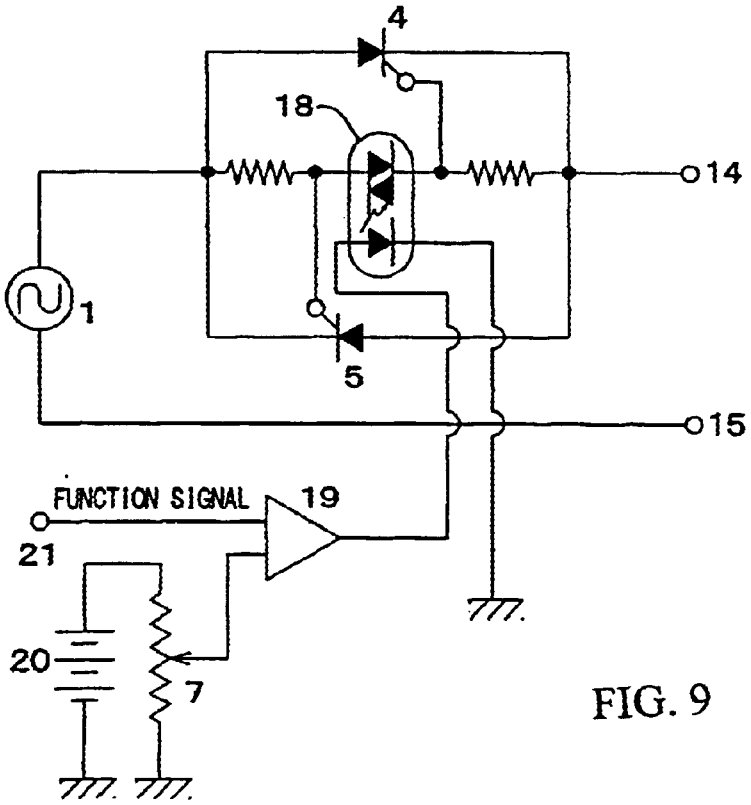
FIG. 9 is a circuit configuration view showing an example of the preferred embodiment of the dimmer of the present invention.

In FIG. 9 is illustrated a practical example of the dimmer having the output voltage waveform shown in FIG. 8.

In FIG. 9, the elements having the same reference symbols as that of FIG. 7 show the same action and have the same action and effect as that in FIG. 7.

In FIG. 9, the operating unit 7 is driven by a DC power supply 20 and an output of the operating unit 7 is fed to one terminal of the comparator 19.

Figure 10:
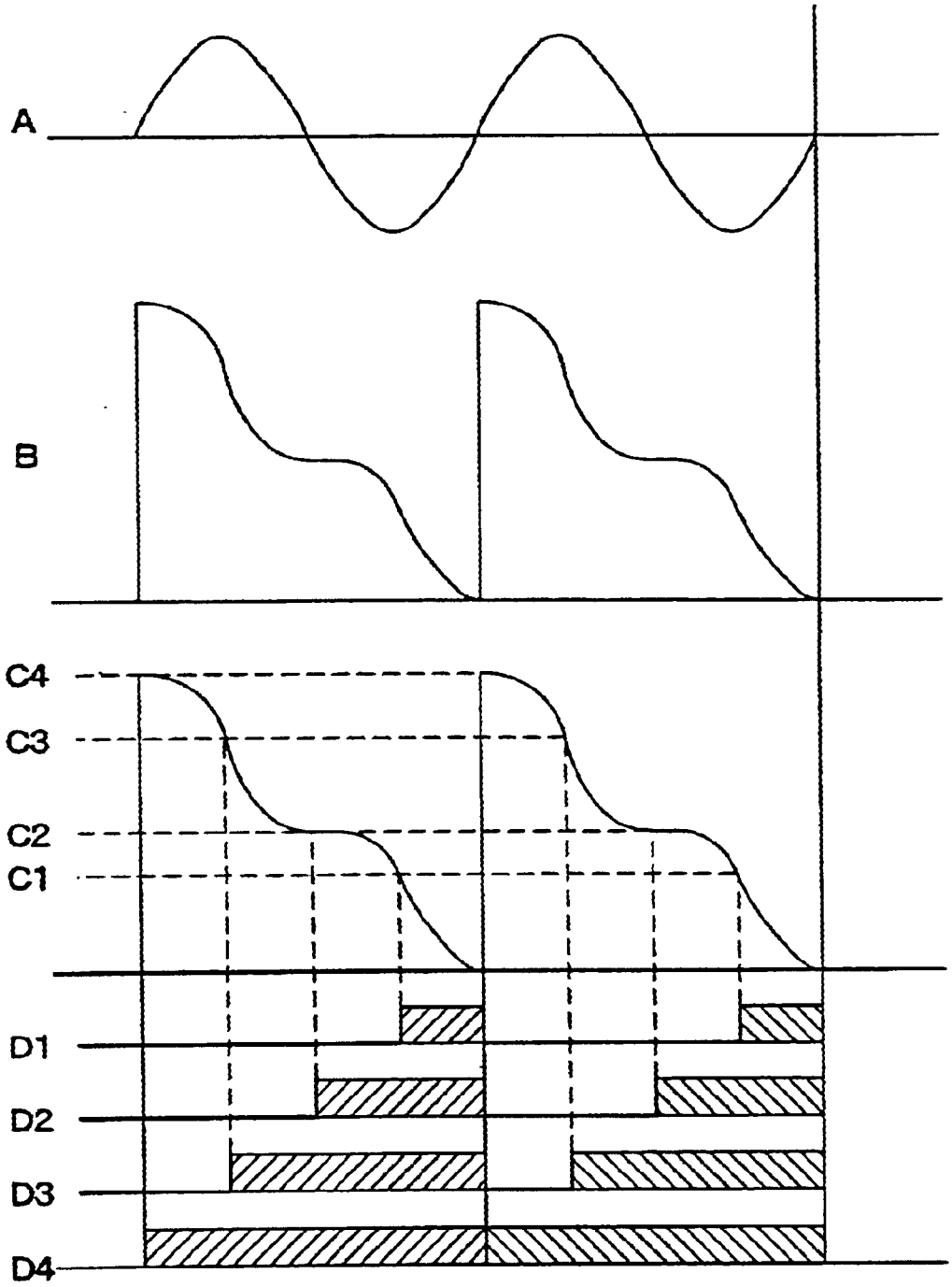
FIG. 10 is a relative view showing an input voltage waveform, a function waveform and an ignition signal waveform in the example in FIG. 9.

To the other terminal 21 of the comparator 19 is always applied a function waveform shown at B in FIG. 10, and this function waveform is in synchronous with the power supply waveform shown at A in FIG. 10.

At the comparator 19, the function waveform is compared with an output of the operating unit 7 to attain an output of the comparator 19 for a period in which an output of the operating unit 7 exceeds the voltage of function waveform. Accordingly, as the output of the operating unit 7 is increased, outputs of D1–D2–D3–D4 in FIG. 10 can be attained.

The output of this comparator 19 is fed to an LED of the photo-thyristor 18 in FIG. 9, the thyristor is ignited for a period in which the LED is lit and the thyristor elements 4 and 5 are also ignited.

In this way, it is possible to attain an output shown in FIG. 8 by operating the operating unit 7.

Second Aspect

Then, an example of a dimmer for an incandescent lamp related to the second aspect of the present invention will be described.

Since the first example related to the second aspect is a circuit configuration similar to that shown in FIG. 3, it is described in reference to FIG. 3. In this example, reference numeral 1 in this figure denotes an AC power supply, reference numeral 2 denotes a thyristor dimmer acting as one example of the dimmer, reference numeral 3 denotes a lighting equipment having the incandescent lamp 8, and reference numerals 9 and 10 denote a separate filament of the incandescent lamp 8, respectively. The dimmer 2 is comprised of thyristor elements 4 and 5 connected in an inverse direction from each other, the ignition circuit 6 and the operating unit 7 for performing an optical adjustment.

Operation of this dimmer 2 controls individually the thyristor element 4 controlling the positive half cycle and the thyristor element 5 controlling the negative half cycle, discriminates the electrical power of positive half cycle and the electrical power of negative half cycle, supplies each of them to the individual filaments 9, 10 of the incandescent lamp 8, starts to supply the electrical power to the second filament 10 when the first filament 9 reaches a specified color temperature, increases further supplying of electrical power for the first filament 9 and accommodates for a reduction in the color temperature.

Figure 13:
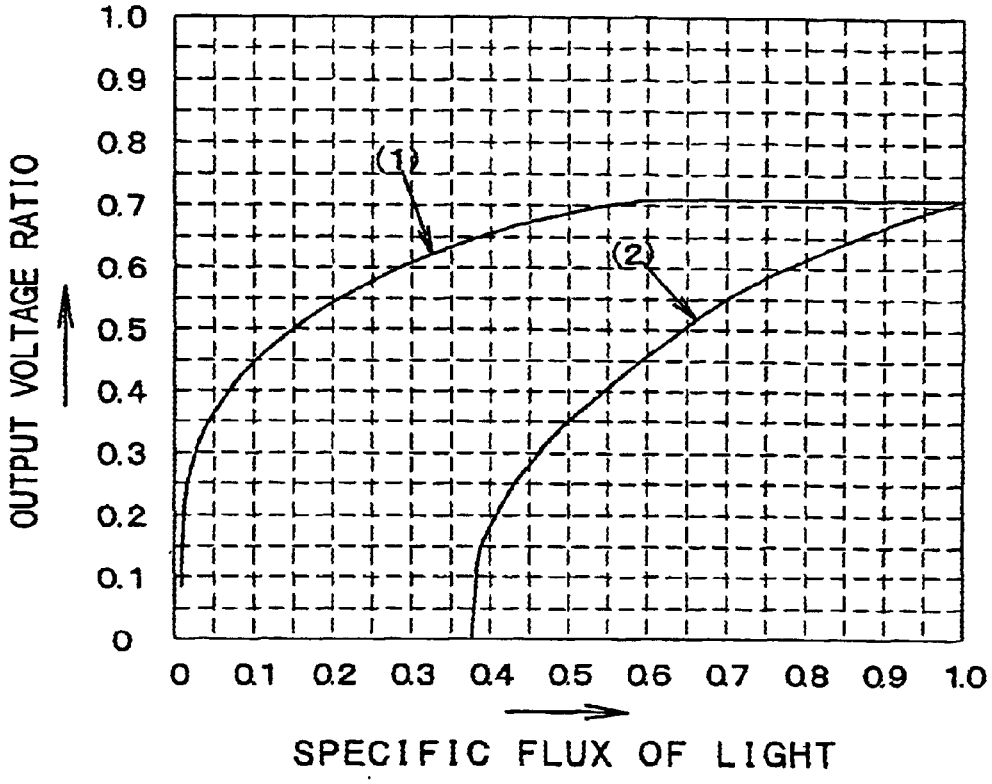
FIG. 13 is a graph showing a specific light flux v.s an output voltage ratio in the example of the second aspect.

For example, when the specific light flux is increased in response to the output of the operating unit 7 as shown in FIG. 13, the output voltage ratio of the negative half cycle is kept in 0% until the output voltage ratio of the positive half cycle reaches 65% of the power supply voltage. When the positive half cycle reaches 65%, the output of the negative half cycle starts to increase, an output voltage of the positive half cycle is also increased continuously until it reaches 60% of the specific light flux (70% of an output voltage) and a reduction of color temperature caused by lighting of the negative half cycle is accommodated.

Figure 11:
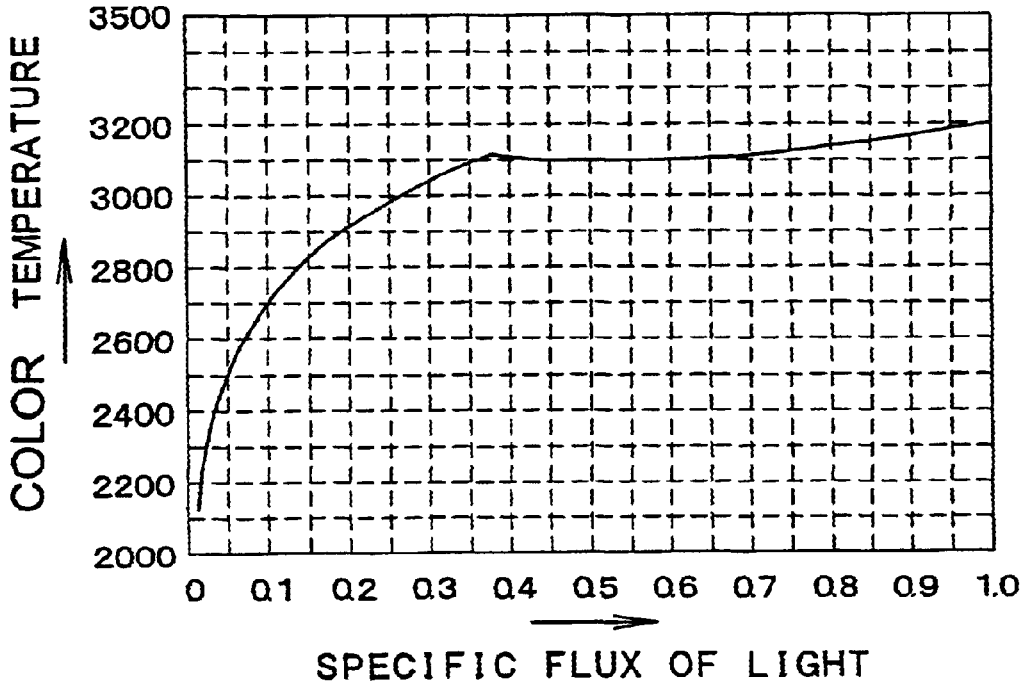
FIG. 11 is a graph for indicating a specific light flux v.s a characteristic of color temperature in which the characteristic of color temperature with the example in the second aspect is further improved.

In FIG. 11 is shown a characteristic of the color temperature in respect to the specific light flux in the case that a bulb having the same rated electrical power ratio of the two filaments 9, 10 and its rated color temperature of 3200K controlled in this way. In FIG. 11, the color temperature at the specific light flux of 37% reaches 3100K and 3100K of the color temperature is kept up to 65% of the specific light flux. The color temperature is gradually increased at a value more than 65% of the specific light flux and the color temperature reaches up to 3200K at 100% of the specific light flux.

Figure 2:
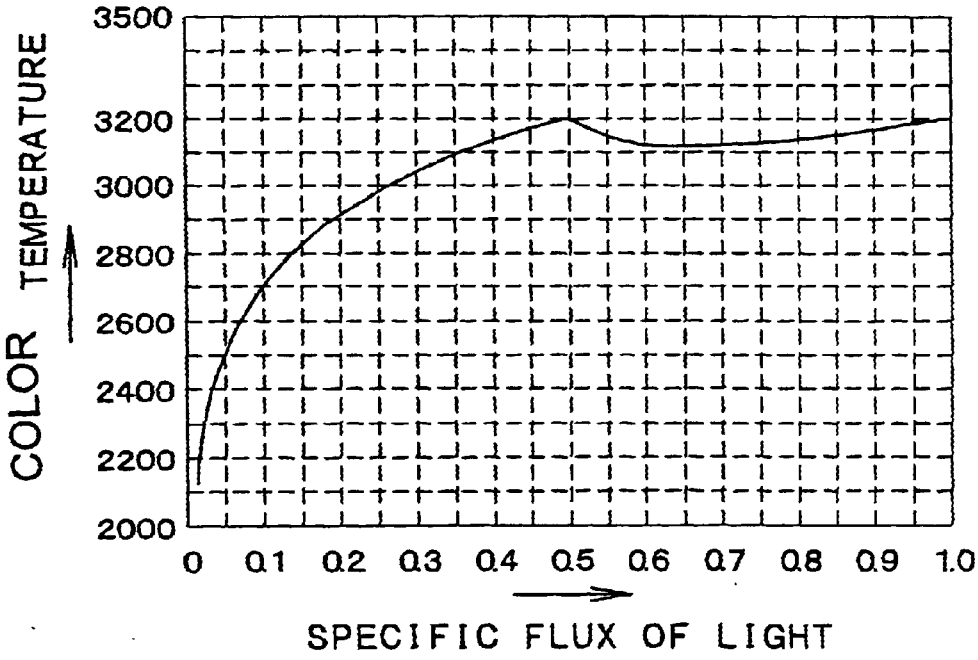
FIG. 2 is a graph for indicating a specific light flux v.s a characteristic of color temperature in which the characteristic of color temperature with the first aspect is improved.

Accordingly, no reduction of color temperature under lighting of the second filament of more than 50% of specific light flux as shown in FIG. 2 is present and so it is possible to keep a value of 3100K or more.

Figure 12:
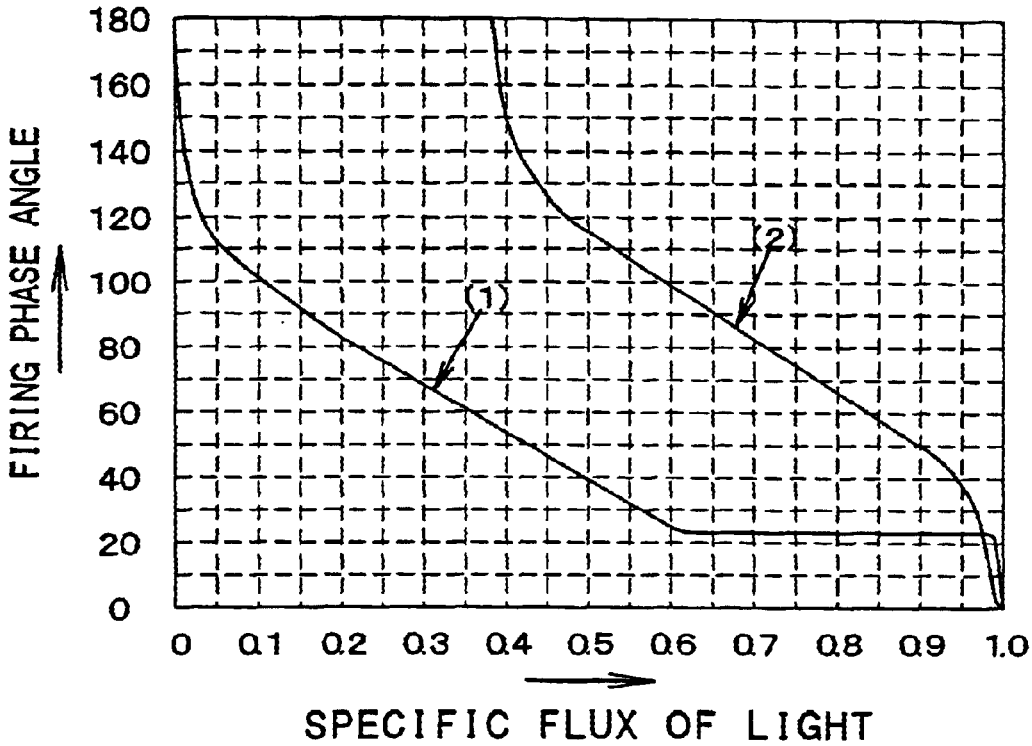
FIG. 12 is a graph showing a specific light flux v.s an ignition phase angle characteristic in the example of the second aspect.

In FIG. 12 is shown a characteristic of the ignition phase angle of the thyristor in respect to the specific light flux in this dimmer 2. In addition, in FIG. 13 are shown the output voltage ratios of the positive direction and negative direction in respect to the specific light flux in the dimmer 2.

Also in this example, it is assumed that the rated values such as an electrical power and an efficiency of both filaments 9, 10 are the same value to each other and each of the specific light flux and color temperature of the filament 10 is defined as LUX1, COL1, respectively, and each of the specific light flux and color temperature of the filament 9 is defined as LUX2, COL2, respectively, resulting in that a specific light flux of an entire incandescent lamp 8 during its optical adjustment operation is (LUX1+LUX2)/2 and a color temperature of the bulb light flux is (LUX1×COL1+LUX2×COL2)/(LUX1+LUX2), respectively.

Figure 14:
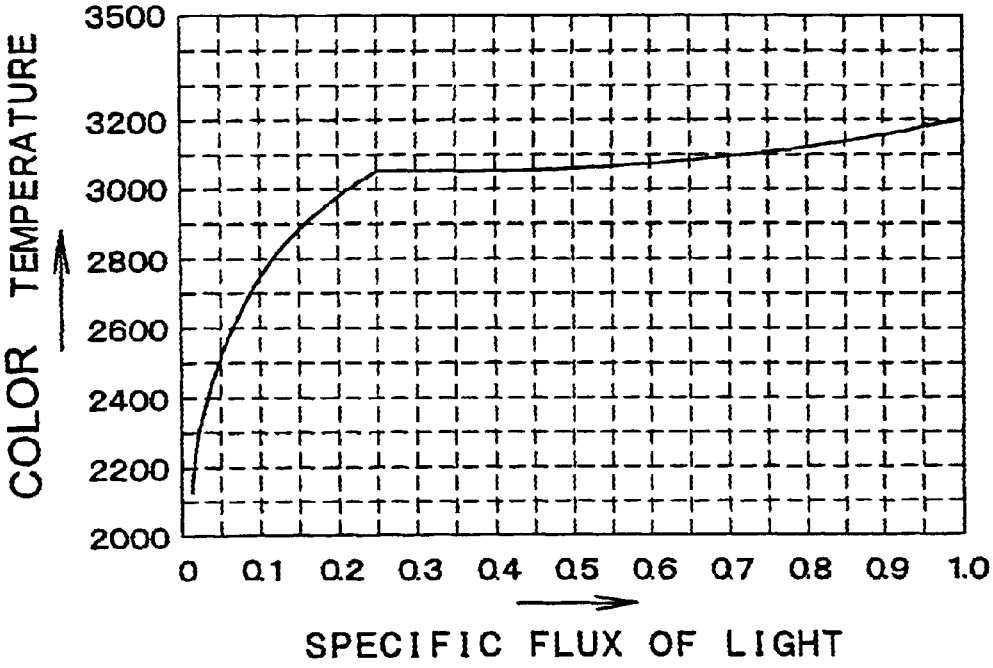
FIG. 14 is a graph showing a specific light flux v.s a color temperature in the case that a rated electrical power ratio in a filament in the example of second aspect is different.

In addition, the rated electrical powers of the two filaments 9, 10 are set to different values, thereby a process of variation in color temperature can be changed. For example, an electrical power ratio of the filament to which the positive half cycle is supplied is 0.4 and an electrical power ratio of the filament to which the negative half cycle is supplied is 0.6, its rated color temperature is 3100K, and when the filament of positive direction reaches 3050K, the dimmer control is performed to cause the lighting for the filament of negative direction to be started, a characteristic of the color temperature shown in FIG. 14 can be attained. In this case, a value of 3050K or more at a specific light flux of more than 25% is kept and it is gradually increased to reach up to 3200K.

Figure 15:
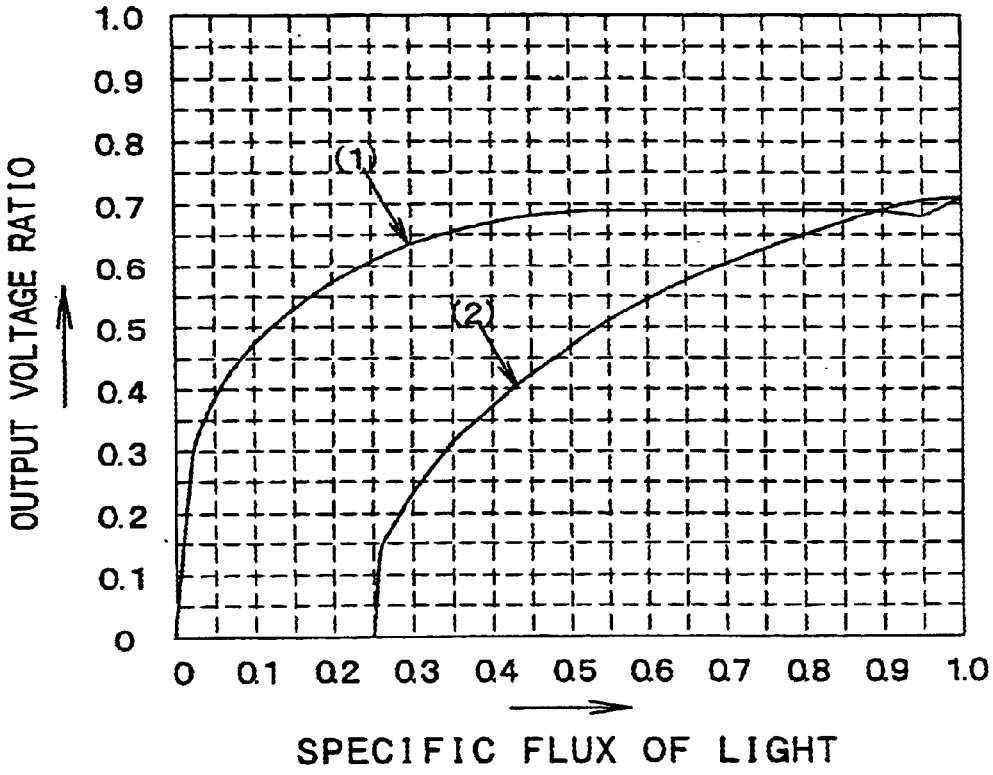
FIG. 15 is a graph showing a specific light flux v.s an output voltage in the case that a rated electrical power ratio in a filament in the example of second aspect is different.

FIG. 15 indicates an output voltage ratio of the dimmer 2 in respect to a specific light flux in each of positive direction and negative direction during the optical adjustment control.

In this way, it is possible to set an optional color temperature process curve by optionally selecting either a rated electrical power or a rated color temperature of both filaments.

Also in this example, similar effects can be attained in the case of a plurality of unit filament bulbs 8', 8 used in the same lighting equipment as shown in FIG. 6 in place of the bulb having two filaments as the incandescent bulb under application of the dimmer 2 operated as described above.

As the second example of the second aspect, it is possible to apply the lighting device having the same circuit configuration as that shown in FIG. 7. In the aforesaid example, when the output of the dimmer 2 is supplied to the lighting equipment 3, the electrical power is supplied to the filament 9 at the positive half cycle and the electrical power is supplied to the filament 10 at the negative half cycle through rectifiers 18, 19 of the lighting equipment 3, respectively, resulting in that the same effects as that of FIG. 3 can be attained.

Figure 16:
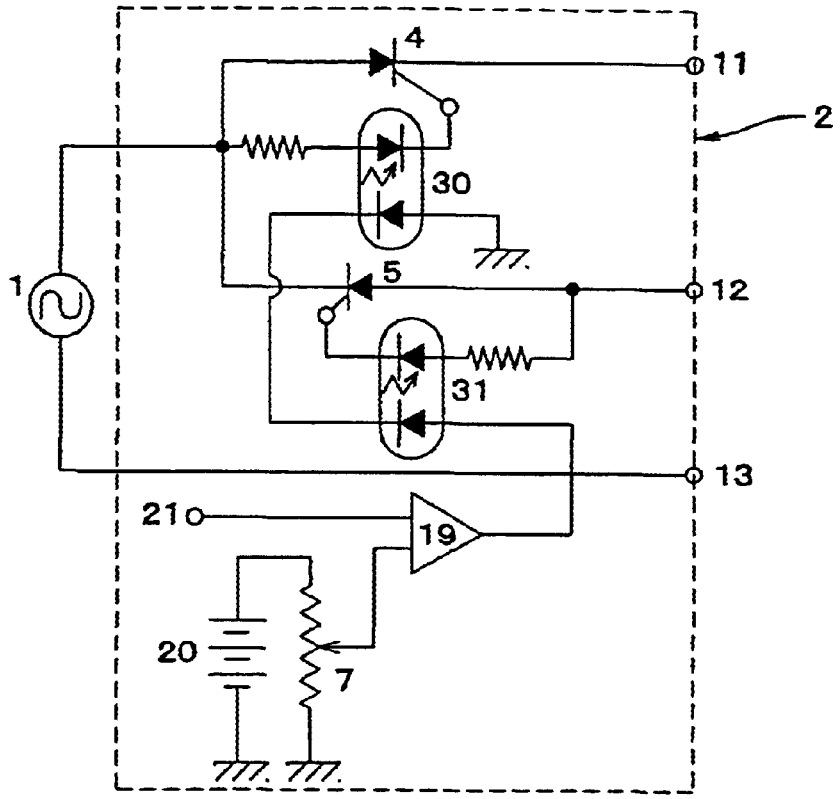
FIG. 16 is a circuit configuration view showing a practical example of a dimmer of the second aspect.

In FIG. 16 is shown a more practical example of configuration of the dimmer 2. In this figure, the composing elements denoted by the same reference numerals as that of the aforesaid drawings show the same action and have the same action and effect as that shown in the previous figures.

Figure 17:
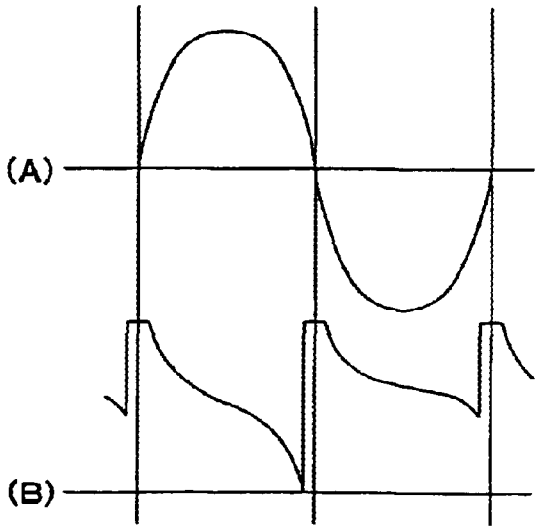
FIG. 17 is a function waveform view of a dimmer of the second aspect.

In FIG. 16, the operating unit 7 is driven by the DC power supply 20, and an output of the operating unit 7 is fed to one terminal of the comparator 19. To the other terminal 21 of the comparator 19 is always applied a function waveform shown at B in FIG. 17, wherein the function waveform is in synchronous with the power supply waveform shown at A of FIG. 17 and the function waveform for every half cycle is different, thereby the aforesaid operation, action and effect can be expected.

At the comparator 19, this function waveform is compared with an output of the operating unit 7 and the output can be attained at the comparator 19 for a period in which the output of the operating unit 7 exceeds the voltage of the function waveform.

The output of this comparator 19 is fed to the LED sides of the photo-thyristors 30, 31 in FIG. 16 and the thyristor to which the forward voltage is applied is ignited for a period in which the LED is lit.

In this way, the operating unit 7 is operated and the characteristic shown in FIG. 13 or FIG. 15 can be attained.

Figure 18:
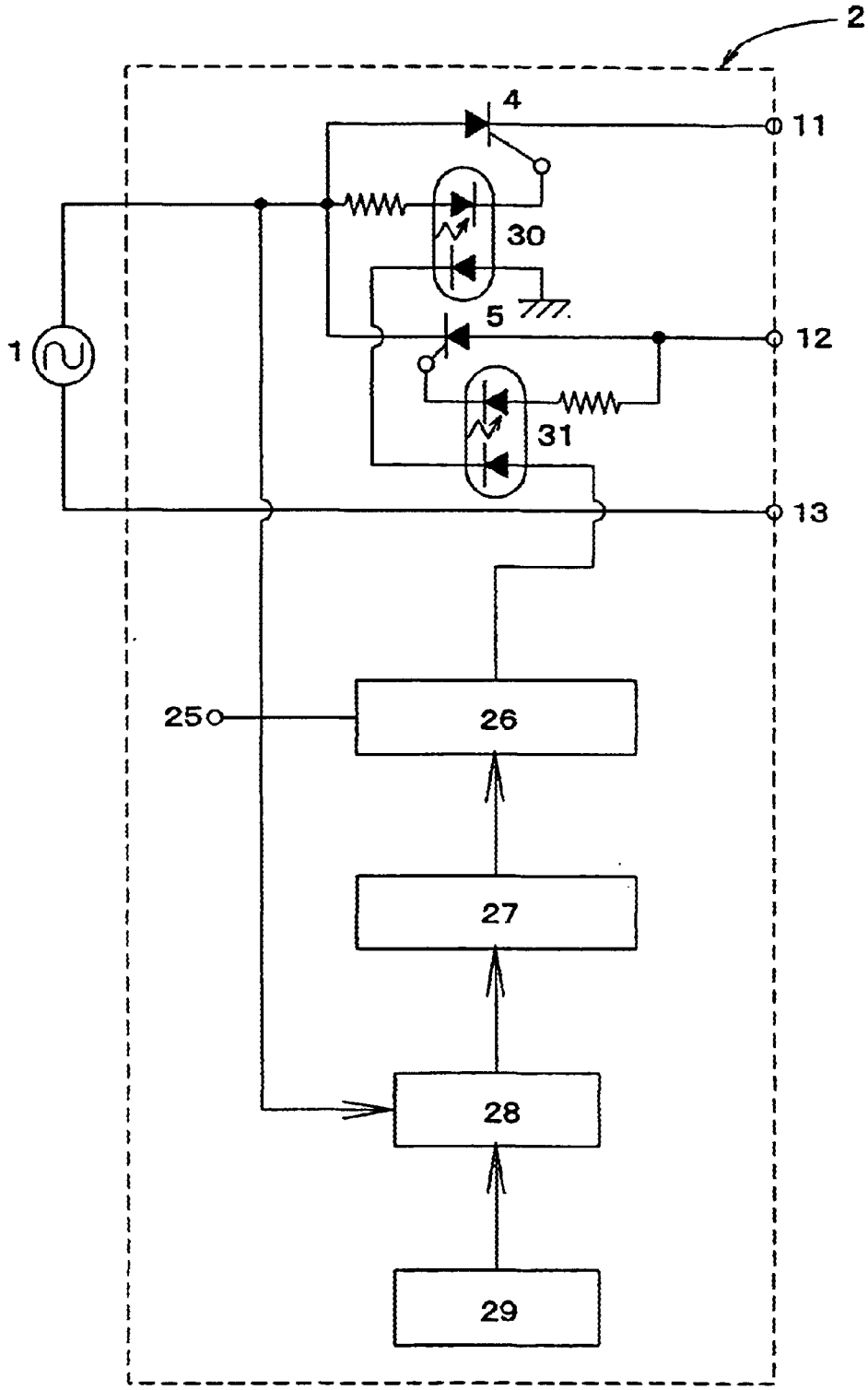
FIG. 18 is a circuit configuration view showing another practical example of a dimmer in the second aspect.

In FIG. 18 is illustrated another example of configuration of the dimmer 2.

In FIG. 18, reference numeral 25 denotes a receiving terminal for a digital optical adjustment signal usually called as DMX 512/1990. This dimmer is a digital dimmer.

Reference numeral 29 denotes a clock generating device, wherein a clock signal is generated at a specified period.

Reference numeral 28 denotes a counter device for use in counting a clock signal, wherein it is reset for every one cycle of the AC power supply voltage at the power supply 1.

Reference numeral 27 denotes a memory device where characteristics of the ignition phase angle v.s an optical adjustment signal of the thyristor elements 4, 5 are written, wherein the output of the counter device 28 is read out as an address.

Reference numeral 26 denotes a digital comparator, wherein a digital optical adjustment control signal supplied to the DMX receiving terminal 25 is compared with data read out of the memory device 27, and when the optical adjustment control signal is larger than the memory data, it may output a signal for lighting LED of the photo-thyristor.

The data written into the memory device 27 corresponds to the operations of the thyristor elements 4, 5, and the data coincided with the characteristic shown in FIG. 13 or FIG. 15 is written.

Also in the digital dimmer constructed as described above, the present invention can be performed.

Several kinds of preferred embodiments of the first aspect and the second aspect have been described in reference to the drawings, although the present invention is not limited to these examples. Although the aforesaid description provides an example in which the thyristor elements are used as the electrical power control element and the switching element, for example, it is of course apparent that IGBT, a power MOS transistor and the like can be used, for example, and this is within a scope of the present invention.

In addition, the dimmer and the dimmer control device operated as described above are not limited to the aforesaid example of configuration, but it is satisfactory if there is provided the dimmer performing an igniting operation for every one period of the power supply waveform, or the dimmer control device in which each of the electrical powers of positive half cycle and negative half cycle of which positive direction and negative direction can be controlled in a respective phase angle is supplied to a separate filament of a bulb and when the first filament reaches a specified color temperature, supplying of the electrical power to the second filament is started and further supplying of electrical power of the first filament can be increased, and various kinds of proposals can be provided.

In accordance with the first aspect of the present invention, the electrical power of positive half cycle and the electrical power of negative half cycle are optically adjusted and controlled and each of the electrical powers is supplied to individual filaments, one filament is raised up fast and the other filament is raised up in delay, so that it is possible to reduce a variation of color temperature at the time of optical adjustment operation.

Accordingly, it becomes possible to perform an optical adjustment operation of less variation in color temperature in the incandescent lighting device for use in a stage lighting or an effect TV studio lighting and the like.

In accordance with the second aspect of the present invention, in addition to the constitution of the aforesaid first aspect, supplying of the electrical power to the second filament is started when the first filament reaches the specified color temperature, and supplying of the electrical power to the first filament is further increased to accommodate for reduction in color temperature, so that it is possible to further improve an effect of the aforesaid first effect.

Accordingly, it becomes possible to perform an optical adjustment operation having a quite less variation in color temperature in an incandescent lighting equipment for use in lighting at a stage or an effect lighting at a TV studio and the like.

As the preferred embodiments of the first aspect and the second aspect described above, in the case in which the rated electrical powers of the two filaments within the same bulb are set to different values and the case in which the rated electrical powers of a plurality of bulbs installed in the same lighting equipment are set to different values, it is possible to change the process in variation of the color temperature. That is, it is possible to set an optional color temperature process curve by attaining a further improvement over reduction in color temperature in a range of low illuminance and reduction in variation of the color temperature under an optional selection of rated electrical powers or rated color temperature of both filaments or bulbs.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A dimmer for an incandescent lamp having a bulb with two individual filaments, wherein a phase angle controlling dimmer for performing one time ignition operation every one period of a power supply waveform is used, an ignition angle is varied continuously to perform an optical adjustment operation, each of the electrical powers of positive half cycle and negative half cycle is supplied to the two individual filaments respective so as to enable an optical adjustment of less variation in color temperature to be attained.

2. The dimmer for an incandescent lamp according to claim 1, including wherein the bulb having the two filaments has an intermediate terminal enclosed therein, and the electrical power of the positive half cycle and the electrical power of the negative half cycle are separately supplied to said two filaments.

3. The dimmer for an incandescent lamp according to claim 2, wherein the rated electrical power ratios of said two filaments are changed.

4. The dimmer for an incandescent lamp according to claim 1, including a plurality of bulbs and the optical adjusted lit bulbs are discriminated in reference to the electrical power of positive half cycle and the electrical power of negative half cycle.

5. The dimmer for an incandescent lamp according to claim 4, wherein the rated electrical power ratios of said plurality of bulbs are changed.

6. The dimmer for an incandescent lamp according to claim 1, wherein as means for changing continuously an ignition angle of a phase angle controlling dimmer, there are provided an optical adjustment controlling function signal generator forming a waveform synchronizing with the power supply waveform and corresponding to one period of the power supply, a comparator and a switching element.

7. A dimmer for an incandescent lamp having first and second filaments, wherein there is provided a dimmer capable of individually controlling a positive half cycle and a negative half cycle of an AC power supply voltage, each of the electrical power of the positive half cycle and the electrical power of the negative half cycle is separately supplied to the filaments and, when the first filament reaches the specified color temperature, electrical power for the second filament is started, electrical power to the first filament is further increased to accommodate for reduction in color temperature.

8. The dimmer for an incandescent lamp according to claim 7, wherein there is provided a bulb having the two filaments with an intermediate terminal enclosed therein, and the electrical power of the positive half cycle and the electrical power of the negative half cycle are separately supplied to said two filaments.

9. The dimmer for an incandescent lamp according to claim 8, wherein the rated electrical power ratios of said two filaments are changed.

10. The dimmer for an incandescent lamp according to claim 7, including a plurality of bulbs and the optical adjusted lit bulbs are discriminated in reference to the electrical power of positive half cycle and the electrical power of negative half cycle.

11. The dimmer for an incandescent lamp according to claim 10, wherein the rated electrical power ratios of said plurality of bulbs are changed.

12. The dimmer for an incandescent lamp according to claim 7 wherein the AC power supply voltage produces a power supply waveform, and wherein said dimmer is comprised of an optical adjustment controlling function signal generator forming a waveform synchronizing with the power supply waveform and corresponding to one period of the power supply, a comparator and a switching element for individually controlling each of the electrical power of positive half cycle and the electrical power of negative half cycle, a function waveform of said function signal generator is compared with an output of an operating unit for performing an optical adjustment operation by the comparator, an output can be attained at the comparator for a period in which the output of the comparator exceeds a voltage of the function waveform, said switching element is ignited with the output from the comparator, an ignition angle of a phase angle controlling dimmer is changed continuously, each of the electrical power of the positive half cycle and the electrical power of the negative half cycle is separately supplied to a separate filament, and at the same time when the first filament reaches a specified color temperature, supplying of the electrical power to the second filament is started, and further supplying of electrical power to the first filament is controlled to be increased.

13. A dimmer for an incandescent lamp having a bulb with individual filaments and an intermediate terminal enclosed therein comprising: a phase angle controller for performing one time ignition operation every one period of a power supply waveform is used having positive and negative half cycles, an ignition angle of the waveform is varied continuously to perform an optical adjustment operation, electrical power the positive half cycle and negative half cycle is supplied to respective to exactly the tow individual filaments so as to enable optical adjustment in color temperature with reduced variation to be attained.

14. The dimmer for an incandescent lamp according to claim 13, wherein the rated electrical power ratios of said tow filaments are changed.

15. The dimmer for an incandescent lamp according to claim 13, including a plurality of bulbs and the optical adjusted lit bulbs are discriminated in reference to the electrical power of positive half cycle and the electrical power of negative half cycle.

16. The dimmer for an incandescent lamp according to claim 15, wherein rated electrical power ratios of said plurality of bulbs are changed.

17. The dimmer for an incandescent lamp according to claim 13, wherein as means for changing continuously an ignition angle of a phase angle controlling dimmer, there are provided an optical adjustment controlling function signal generator forming a waveform synchronizing with the power supply waveform and corresponding to one period of the power supply, a comparator and a switching element.

* * * * *